US008177034B2

(12) United States Patent
Ueda et al.

(10) Patent No.: US 8,177,034 B2
(45) Date of Patent: May 15, 2012

(54) ELEVATOR SYSTEM WHICH CONTROLS A VALUE OF OVERSPEED

(75) Inventors: Takaharu Ueda, Tokyo (JP); Eiji Ando, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 521 days.

(21) Appl. No.: 12/377,026

(22) PCT Filed: Nov. 20, 2006

(86) PCT No.: PCT/JP2006/323105

§ 371 (c)(1),
(2), (4) Date: Feb. 10, 2009

(87) PCT Pub. No.: WO2008/062500

PCT Pub. Date: May 29, 2008

(65) Prior Publication Data

US 2010/0155182 A1 Jun. 24, 2010

(51) Int. Cl.
*B66B 1/34* (2006.01)

(52) U.S. Cl. ..... 187/391; 187/293

(58) Field of Classification Search ..... 187/277, 187/286, 287, 293, 305, 391–393
See application file for complete search history.

(56) References Cited

U.S. PATENT DOCUMENTS

| | | | | |
|---|---|---|---|---|
| 4,101,013 | A * | 7/1978 | Duriez et al. | 187/293 |
| 4,700,811 | A * | 10/1987 | Evin | 187/293 |
| 5,773,771 | A * | 6/1998 | Chatham | 187/282 |
| 6,138,798 | A * | 10/2000 | Macuga | 187/294 |
| 6,202,797 | B1 * | 3/2001 | Skolnick et al. | 187/317 |
| 6,223,861 | B1 * | 5/2001 | Sansevero | 187/316 |
| 6,736,242 | B2 * | 5/2004 | Nygren | 187/357 |
| 7,228,943 | B2 * | 6/2007 | Kugiya et al. | 187/393 |
| 7,249,656 | B2 * | 7/2007 | Huber et al. | 187/343 |
| 7,533,763 | B2 * | 5/2009 | Kattainen et al. | 187/394 |
| 7,650,969 | B2 * | 1/2010 | Monzon et al. | 187/300 |
| 7,832,526 | B2 * | 11/2010 | Sirigu | 187/357 |
| 7,891,467 | B2 * | 2/2011 | Kattainen et al. | 187/394 |
| 2006/0124399 | A1 | 6/2006 | Kugiya et al. | |

FOREIGN PATENT DOCUMENTS

| | | |
|---|---|---|
| JP | 59 64484 | 4/1984 |
| JP | 9 58942 | 3/1997 |
| JP | 2000 327239 | 11/2000 |
| JP | 2002 356282 | 12/2002 |
| JP | 2005 206346 | 8/2005 |
| WO | 03 029123 | 4/2003 |
| WO | 2005 049468 | 6/2005 |

* cited by examiner

*Primary Examiner* — Anthony Salata

(74) *Attorney, Agent, or Firm* — Oblon, Spivak, McClelland, Maier & Neustadt, L.L.P.

(57) ABSTRACT

An elevator system in which a controller monitors whether or not a speed of an ascending/descending body reaches a preset overspeed. At a time of maintenance work, a stopper is interposed between a buffer and the ascending/descending body to limit a lowered position of the ascending/descending body. A stopper detector detects installation of the stopper onto at least one of the buffer and the ascending/descending body. When the stopper is detected by the stopper detector, the controller lowers a set value of the overspeed.

10 Claims, 7 Drawing Sheets

ELEVATOR SYSTEM WHICH CONTROLS A VALUE OF OVERSPEED

TECHNICAL FIELD

The present invention relates to an elevator system, for which maintenance work is performed in a hoistway.

BACKGROUND ART

In a conventional elevator system, when a maintenance person on a car performs maintenance work for a device provided at the top of a hoistway, counterweight block means is connected to an upper portion of a plunger of a counterweight buffer. Then, a counterweight is lowered to abut against the counterweight block means to compress the counterweight buffer. As a result, a lowered position of the counterweight is restricted to be higher than that without using the counterweight block means, thereby allowing a work space between the car and a ceiling of the hoistway to be sufficiently ensured (for example, see Patent Document 1).

Patent Document 1: JP 2000-327239 A

DISCLOSURE OF THE INVENTION

Problem to be Solved by the Invention

In the conventional elevator system as described above, the counterweight abuts against the counterweight block means at a position higher than that at which the counterweight abuts against the counterweight buffer without using the counterweight block means. Therefore, if some abnormality occurs in a maintenance operation control section when the counterweight is caused to abut against the counterweight block means, there is a fear that the counterweight collides against the counterweight block means at a speed exceeding an allowable collision speed for the counterweight buffer. Because the counterweight block means is directly connected to the counterweight at this time, there is a fear that the counterweight buffer may be damaged by the impact of the collision.

The present invention has been made for solving the problem as described above, and has an object to provide an elevator system capable of reliably keeping down speeds of a car and a counterweight when there is a possibility that maintenance work is being performed in a hoistway.

Means for the Solving the Problem

An elevator system according to the present invention includes: an ascending/descending body being raised and lowered in a hoistway; a controller for monitoring whether or not a speed of the ascending/descending body reaches a preset overspeed; a buffer provided in a lower part of the hoistway; a stopper being interposed between the buffer and the ascending/descending body at a time of maintenance work to limit a lowered position of the ascending/descending body; and stopper detection means for detecting installation of the stopper onto at least one of the buffer and the ascending/descending body, in which the controller lowers a set value of the overspeed when the stopper is detected by the stopper detection means.

Further, an elevator system according to the present invention includes: an ascending/descending body being raised and lowered in a hoistway; a controller for monitoring whether or not a speed of the ascending/descending body reaches a preset overspeed; a stopper being interposed between the ascending/descending body and a ceiling of the hoistway at a time of maintenance work to limit a raised position of the ascending/descending body; and stopper detection means for detecting installation of the stopper onto at least one of the ascending/descending body and the ceiling of the hoistway, in which the controller lowers a set value of the overspeed when the stopper is detected by the stopper detection means.

Further, an elevator system according to the present invention includes: a car being raised and lowered in a hoistway; and a controller for controlling an ascent/descent of the car in a plurality of operation modes including a normal operation mode and a maintenance operation mode in which the car is raised/lowered at a speed lower than that in the normal operation mode and for monitoring whether or not a speed of the car reaches a preset overspeed, in which the controller lowers a set value of the overspeed when the operation mode is switched to the maintenance operation mode.

Further, an elevator system according to the present invention includes: a car having a car door and being raised and lowered in a hoistway; a controller for monitoring whether or not a speed of the car reaches a preset overspeed; a plurality of landing doors; and door opening/closing detection means for detecting open/close states of the car door and the landing doors, in which the controller lowers a set value of the overspeed when the door opening/closing detection means detects that at least one of the car door and the landing doors is opened.

Further, an elevator system according to the present invention includes: a car being raised and lowered in a hoistway; a controller for monitoring a position of the car and for monitoring whether or not a speed of the car reaches a preset overspeed; a plurality of landing doors; and door opening/closing detection means for detecting open/close states of the landing doors, in which the controller lowers a set value of the overspeed when the door opening/closing detection means detects that the landing door at a floor other than that at which the car currently stops is opened.

Further, an elevator system according to the present invention includes: a car being raised and lowered in a hoistway; a controller for monitoring whether or not a speed of the car reaches a preset overspeed; and means for people detection on top of the car for detecting whether or not a person is present on top of the car, in which the controller lowers a set value of the overspeed when the means for people detection on top of the car detects that the person is present on top of the car.

BEST MODE FOR CARRYING OUT THE INVENTION

Figure 1:
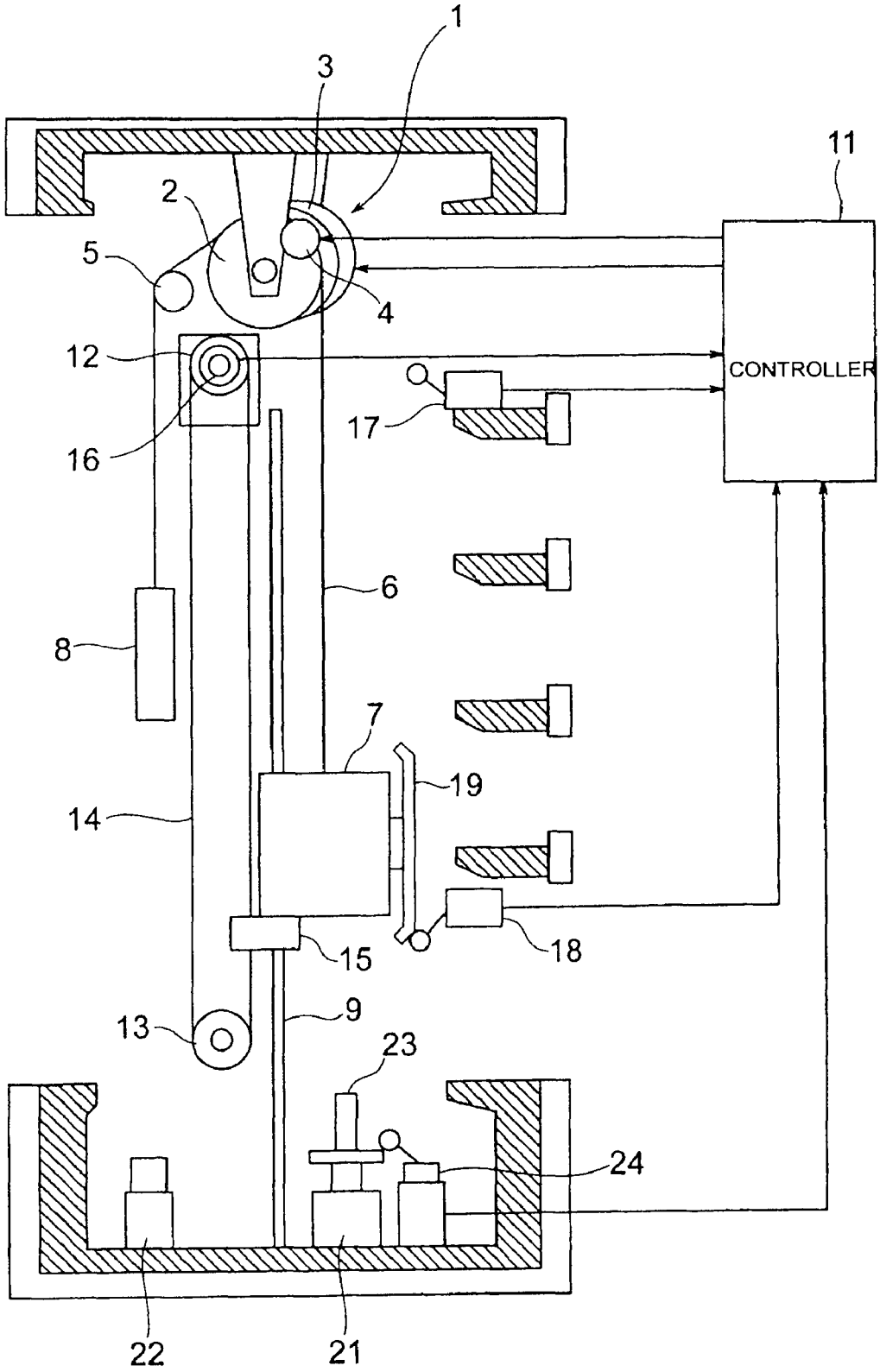
FIG. 1 A configuration diagram illustrating an elevator system according to a first embodiment of the present invention.

Hereinafter, preferred embodiments of the present invention are described referring to the drawings.

First Embodiment

FIG. 1 is a configuration diagram illustrating an elevator system according to a first embodiment of the present invention. In the drawing, a hoisting machine 1 is installed in an upper part of a hoistway. The hoisting machine 1 includes a driving sheave 2, a motor 3 for rotating the driving sheave 2, and a brake device 4 for braking the rotation of the driving sheave 2. In the vicinity of the hoisting machine 1, a deflector sheave 5 is provided.

A plurality of main ropes 6 (only one thereof is illustrated in the drawing) is looped around the driving sheave 2 and the deflector sheave 5. A car 7 and a counterweight 8 corresponding to ascending/descending bodies are suspended by the main ropes 6 in the hoistway, and are raised and lowered by a drive force of the hoisting machine 1. In the hoistway, a pair of car guide rails 9 for guiding the ascent/descent of the car 7, and a pair of counterweight guide rails (not shown) for guiding the ascent/descent of the counterweight 8 are provided.

The motor 3 and the brake device 4 are controlled by a controller 11. Specifically, a travel of the car 7 is controlled by the controller 11.

In the upper part of the hoistway, an upper pulley 12 is provided. In a lower part of the hoistway, a lower pulley 13 is provided. A speed detection rope 14 is looped around the upper pulley 12 and the lower pulley 13. Both ends of the speed detection rope 14 are connected to a safety device (rope securing device) 15 provided for the car 7.

When the car 7 is raised and lowered, the speed detection rope 14 is circulated to rotate the upper pulley 12 at a speed according to the car speed. A rotation detector 16 for generating a signal according to the rotation speed of the upper pulley 12, specifically, a signal according to the car speed, is provided in the upper pulley 12. As the rotation detector 16, for example, an encoder is used.

The signal from the rotation detector 16 is input to the controller 11. The controller 11 computes a car position and the car speed on the basis of the signal from the rotation detector 16. The controller 11 also monitors whether the car speed does not reach a preset overspeed (threshold value).

In the vicinity of a top terminal landing in the hoistway, a top terminal landing switch 17 corresponding to top terminal landing detection means is provided. In the vicinity of a bottom terminal landing in the hoistway, a bottom terminal landing switch 18 corresponding to bottom terminal landing detection means is provided. The car 7 is provided with a cam 19 for operating the terminal landing switches 17 and 18.

The terminal landing switches 17 and 18 are connected to the controller 11. The controller 11 detects that the car 7 has reached the vicinity of the terminal landing upon the operation of the terminal landing switches 17 and 18 performed by the cam 19. The controller 11 also corrects car position information obtained from the rotation detector 16 on the basis of absolute position information obtained from the terminal landing switches 17 and 18.

A car buffer 21 for receiving the car 7 and a counterweight buffer 22 for receiving the counterweight 8 are installed in the lower part of the hoistway.

At the time of maintenance work in a pit of the hoistway, a car stopper (spacer) 23 is connected onto a plunger of the car buffer 21. The car stopper 23 is connected to the car buffer 21 at the time of the maintenance work and is caused to abut against the car 7 to limit a lowered position of the car 7. Specifically, the connection of the car stopper 23 to the car buffer 21 allows a distance between a lower part of the car 7 and a bottom part of the hoistway to be sufficiently ensured when the car buffer 21 is compressed by the car 7. The car stopper 23 is removed from the car buffer 21 at the time of a normal operation.

In the vicinity of the car buffer 21, a car stopper detection switch 24 corresponding to car stopper detection means for mechanically detecting that the car stopper 23 has installed onto the car buffer 21 is provided. The car stopper detection switch 24 is connected to the controller 11. Upon detection of the car stopper 23 by the car stopper detection switch 24, the controller 11 forcibly sets an operation mode of the car 7 to a maintenance operation mode.

Figure 2:
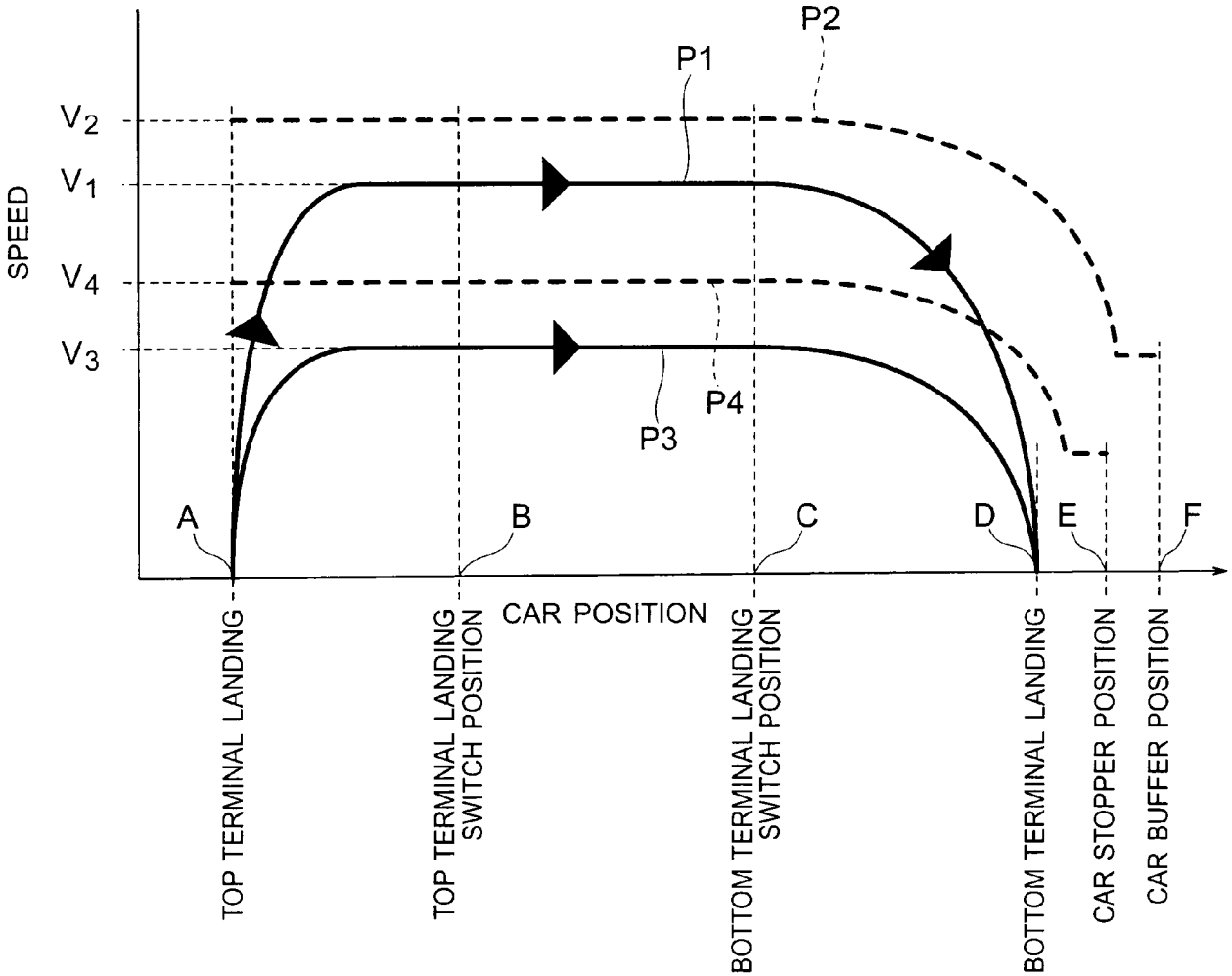
FIG. 2 A graph illustrating an overspeed pattern for a normal operation and an overspeed pattern for a maintenance operation, which are set for a controller illustrated in FIG. 1.

FIG. 2 is a graph illustrating an overspeed pattern for the normal operation and an overspeed pattern for the maintenance operation, which are set for the controller 11 illustrated in FIG. 1. A position A is a position of the top terminal landing, a position B is a position of the top terminal landing switch 17, a position C is a position of the bottom terminal landing switch 18, a position D is a position of the bottom terminal landing, a position E is a position of the car stopper 23, and a position F is a position of the car buffer 21.

The overspeed serving as a criterion for the judgment of an abnormal car speed is set as a pattern according to a running direction and an absolute position of the car 7, specifically, as an overspeed pattern. Moreover, different overspeed patterns are set for the normal operation and the maintenance operation of the car 7, respectively.

In FIG. 2, a pattern P1 in a solid line, which has a maximum speed of V1, represents a running speed pattern when the normal operation of the car 7 is performed from the top terminal landing to the bottom terminal landing. A pattern P2 in a broken line, which has a maximum speed of V2, represents an overspeed pattern for the normal operation. A pattern P3 in a solid line, which has a maximum speed of V3, represents a running speed pattern when the maintenance operation of the car 7 is performed from the top terminal landing to the bottom terminal landing. A pattern P4 in a broken line, which has a maximum speed of V4, represents an overspeed pattern for the maintenance operation.

When the controller 11 judges that the car speed has reached the overspeed, the controller 11 de-energizes the motor 3 and causes the brake device 4 to perform a brake operation, thereby causing the car 7 to make an emergency stop. Moreover, when the installation of the car stopper 23 onto the car buffer 21 is detected by the car stopper detection switch 24, the controller 11 switches the overspeed pattern from P2 to P4 to lower a set value of the overspeed. Further, the overspeed pattern is set so as to allow a collision speed of the car 7 against the car buffer 21 to be equal to or lower than an allowable collision speed according to performance of the car buffer 21.

Figure 3:
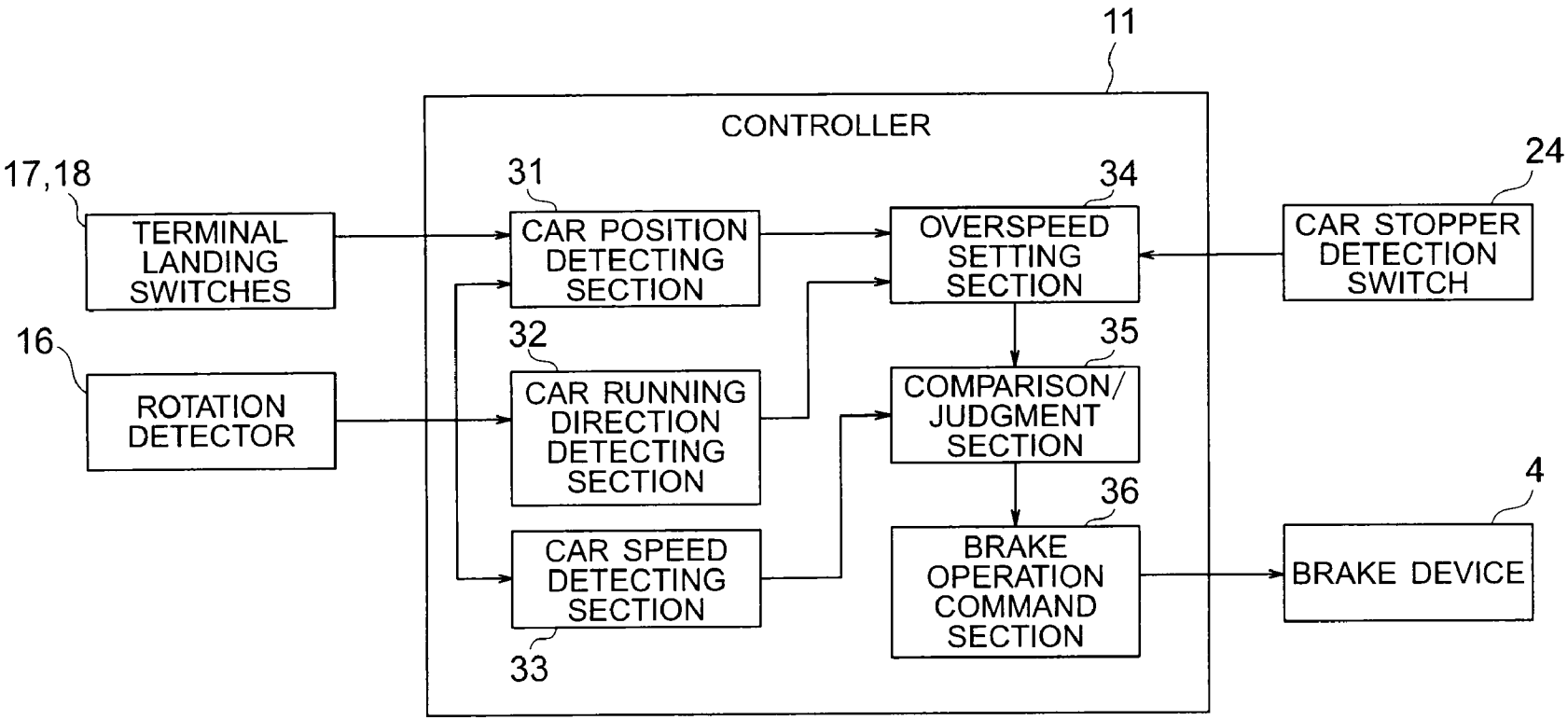
FIG. 3 A block diagram illustrating functions of the controller illustrated in FIG. 1.

FIG. 3 is a block diagram illustrating functions of the controller 11 illustrated in FIG. 1. The controller 11 includes a car position detecting section 31, a car running direction detecting section 32, a car speed detecting section 33, an overspeed setting section 34, a comparison/judgment section 35, and a brake operation command section 36.

The car position detecting section 31 detects the position of the car 7 on the basis of information from the rotation detector 16 and the terminal landing switches 17 and 18. At this time, a detection error of the rotation detector 16 due to slip between the upper pulley 12 and the speed detection rope 14 and the like is corrected by the information from the terminal landing switches 17 and 18.

The car running direction detecting section 32 detects a running direction of the car 7 on the basis of the information from the rotation detector 16. Moreover, by providing a hysteresis element for signal processing, the car running direction detecting section 32 can eliminate a slight change in the running direction of the car 7 due to a disturbance to prevent the running direction from being unnecessarily reversed.

The car speed detecting section 33 converts the information of the amount of rotations, which is detected by the rotation detector 16, into information of a time variation, thereby to detect the speed of the car 7.

The overspeed setting section 34 sets the overspeed serving as the current criterion for judgment on the basis of the car position detected by the car position detecting section 31, the running direction detected by the car running direction detecting section 32, the information from the car stopper detection switch 24, and the overspeed patterns as illustrated in FIG. 2.

The comparison/judgment section 35 judges whether or not the car speed detected by the car speed detecting section 33 has reached the overspeed set by the overspeed setting section 34. When an abnormality is detected by the comparison/judgment section 35, an emergency brake command is output from the brake operation command section 36 to the brake device 4.

Here, the controller 11 includes a computer (not shown) having an arithmetic processing unit (CPU), a storage section (ROM, RAM, hard disk and the like), and a signal input/output section. Functions of the car position detecting section 31, the car running direction detecting section 32, the car speed detecting section 33, the overspeed setting section 34, the comparison/judgment section 35, and the brake operation command section 36 are realized by the computer. Specifically, programs for realizing the functions of the controller 11 are stored in the storage section of the computer. The arithmetic processing unit executes arithmetic processing related to the functions of the controller 11 on the basis of the programs.

Moreover, the overspeed set in the controller 11 is a first overspeed. When the speed of the car 7 further increases to reach a second overspeed (>the first overspeed) although the brake device 4 is operated, the safety device 15 is operated by a speed governor (not shown).

In the elevator system as described above, when the installation of the car stopper 23 onto the car buffer 21 is detected, the overspeed pattern is switched to automatically change the collision speed against the buffer. Therefore, even if the abnormality occurs in the control for the maintenance operation, the car 7 can be prevented from colliding against the car stopper 23 at a speed exceeding the allowable collision speed of the car buffer 21. As a result, the car buffer 21 and the car stopper 23 can be prevented from being damaged.

Moreover, the car 7 is inhibited from entering the pit by the car stopper 23 during the maintenance work performed in the pit, and hence a work space for a maintenance person can be sufficiently ensured.

Further, the set value of the overspeed in an area in the vicinity of the bottom terminal landing is gradually decreased according to the distance to the bottom terminal landing, and hence the design collision speed of the car 7 against the car buffer 21 and the car stopper 23 can be set low. As a result, the strengths of the car buffer 21 and the car stopper 23 can be lowered to reduce the cost.

While the car stopper 23 is connected onto the car buffer 21 in the first embodiment, the car stopper 23 may be provided on the lower part of the car 7. Specifically, it is sufficient to provide the car stopper 23 onto at least one of the car buffer 21 and the car 7 so as to interpose the car stopper 23 between the car buffer 21 and the car 7 during the maintenance work.

Second Embodiment

Figure 4:
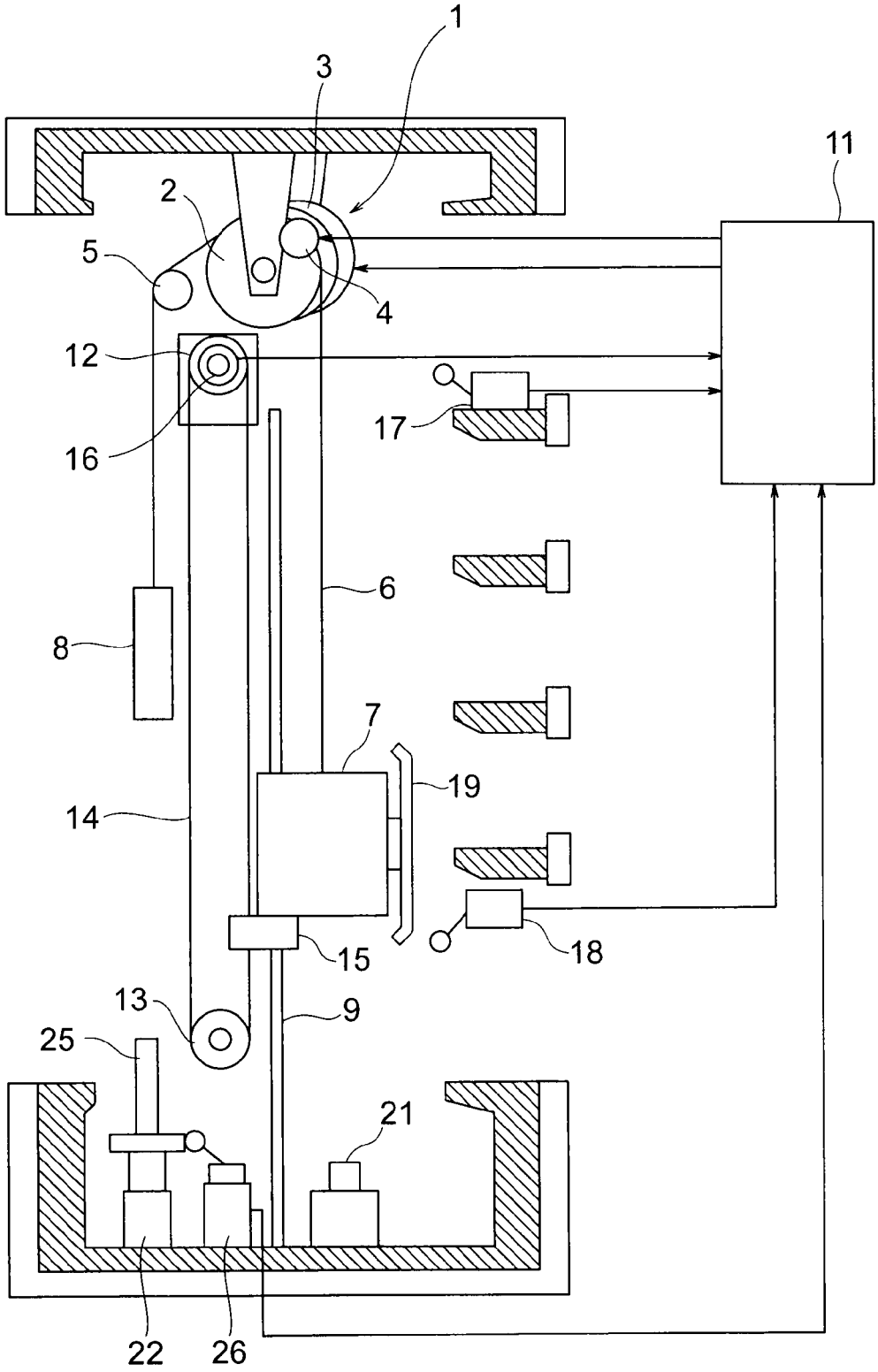
FIG. 4 A configuration diagram illustrating an elevator system according to a second embodiment of the present invention.

Next, FIG. 4 is a configuration diagram illustrating an elevator system according to a second embodiment of the present invention. At the time of the maintenance work performed on the car 7, a counterweight stopper (spacer) 25 is connected onto a plunger of a counterweight buffer 22. The counterweight stopper 25 is connected to the counterweight buffer 22 during the maintenance work to abut against the counterweight 8 corresponding to the ascending/descending body. As a result, the lowered position of the counterweight 8 is limited to limit the raised position of the car 7. Specifically, the connection of the counterweight stopper 25 to the counterweight buffer 22 can ensure a distance between the upper part of the car 7 and the ceiling of the hoistway when the counterweight buffer 22 is compressed by the counterweight 8. The counterweight stopper 25 is removed from the counterweight buffer 22 at the time of the normal operation.

In the vicinity of the counterweight buffer 22, a counterweight stopper detection switch 26 corresponding to counterweight stopper detection means for mechanically detecting that the counterweight stopper 25 has installed onto the counterweight buffer 22 is provided. The counterweight stopper detection switch 26 is connected to the controller 11. Upon detection of the counterweight stopper 25 by the counterweight stopper detection switch 26, the controller 11 forcibly sets an operation mode of the car 7 to a maintenance operation mode. Other construction is the same as that in the first embodiment.

Figure 5:
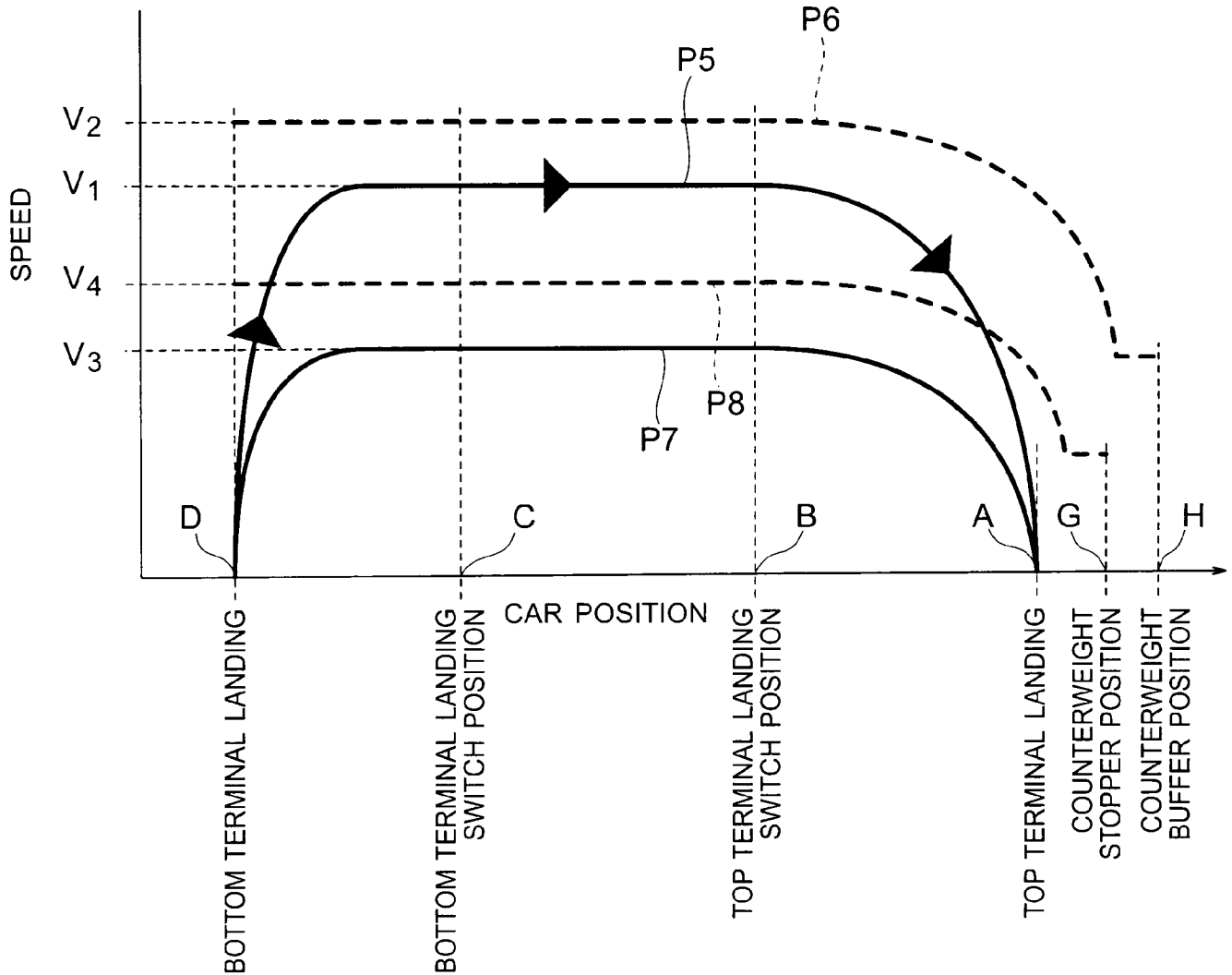
FIG. 5 A graph illustrating the overspeed pattern for the normal operation and the overspeed pattern for the maintenance operation, which are set for the controller illustrated in FIG. 4.

FIG. 5 is a graph illustrating an overspeed pattern for the normal operation and an overspeed pattern for the maintenance operation, which are set for the controller 11 illustrated in FIG. 1. The positions A to D are the same as those in FIG. 2. A position G is a position of the counterweight stopper 25, and a position H is a position of the counterweight buffer 22.

The overspeed serving as a criterion for the judgment of an abnormal car speed is set as a pattern according to a running direction and an absolute position of the car 7, specifically, as an overspeed pattern. Moreover, different overspeed patterns are set for the normal operation and the maintenance operation of the car 7, respectively.

In FIG. 5, a pattern P5 in a solid line, which has a maximum speed of V1, represents a running speed pattern when the normal operation of the car 7 is performed from the bottom terminal landing to the top terminal landing. A pattern P6 in a broken line, which has a maximum speed of V2, represents an overspeed pattern for the normal operation. A pattern P7 in a solid line, which has a maximum speed of V3, represents a running speed pattern when the maintenance operation of the car 7 is performed from the bottom terminal landing to the top terminal landing. A pattern P8 in a broken line, which has a maximum speed of V4, represents an overspeed pattern for the maintenance operation.

When the controller 11 judges that the car speed has reached the overspeed, the controller 11 de-energizes the motor 3 and causes the brake device 4 to perform a brake operation, thereby causing the car 7 to make an emergency stop. Moreover, when the installation of the counterweight stopper 25 onto the counterweight buffer 22 is detected by the counterweight stopper detection switch 26, the controller 11 switches the overspeed pattern from P6 to P8 to lower a set value of the overspeed. Further, the overspeed pattern is set to allow a collision speed of the counterweight 8 against the counterweight buffer 22 to be equal to or lower than an allowable collision speed according to performance of the counterweight buffer 22.

In the elevator system as described above, when the installation of the counterweight stopper 25 onto the counterweight buffer 22 is detected, the overspeed pattern is switched to automatically change the collision speed against the buffer. Therefore, even if the abnormality occurs in the control for the maintenance operation, the counterweight 8 can be prevented from colliding against the counterweight stopper 25 at a speed exceeding the allowable collision speed of the counterweight buffer 22. As a result, the counterweight buffer 22 and the counterweight stopper 25 can be prevented from being damaged.

Moreover, the car 7 is inhibited from entering the top of the hoistway by the counterweight stopper 25 during the maintenance work performed on the car 7, and hence a work space for a maintenance person can be sufficiently ensured.

Further, the set value of the overspeed in an area in the vicinity of the top terminal landing is gradually decreased according to the distance to the top terminal landing, and hence the design collision speed of the counterweight 8 against the counterweight buffer 22 and the counterweight stopper 25 can be set low. As a result, the strengths of the counterweight buffer 22 and the counterweight stopper 25 can be lowered to reduce the cost.

While the counterweight stopper 25 is connected onto the counterweight buffer 22 in the second embodiment, the counterweight stopper 25 may be provided on the lower part of the counterweight 8. Specifically, it is sufficient to provide the counterweight stopper 25 onto at least one of the counterweight buffer 22 and the counterweight 8 to interpose the counterweight stopper 25 between the counterweight buffer 22 and the counterweight 8 during the maintenance work.

Third Embodiment

Figure 6:
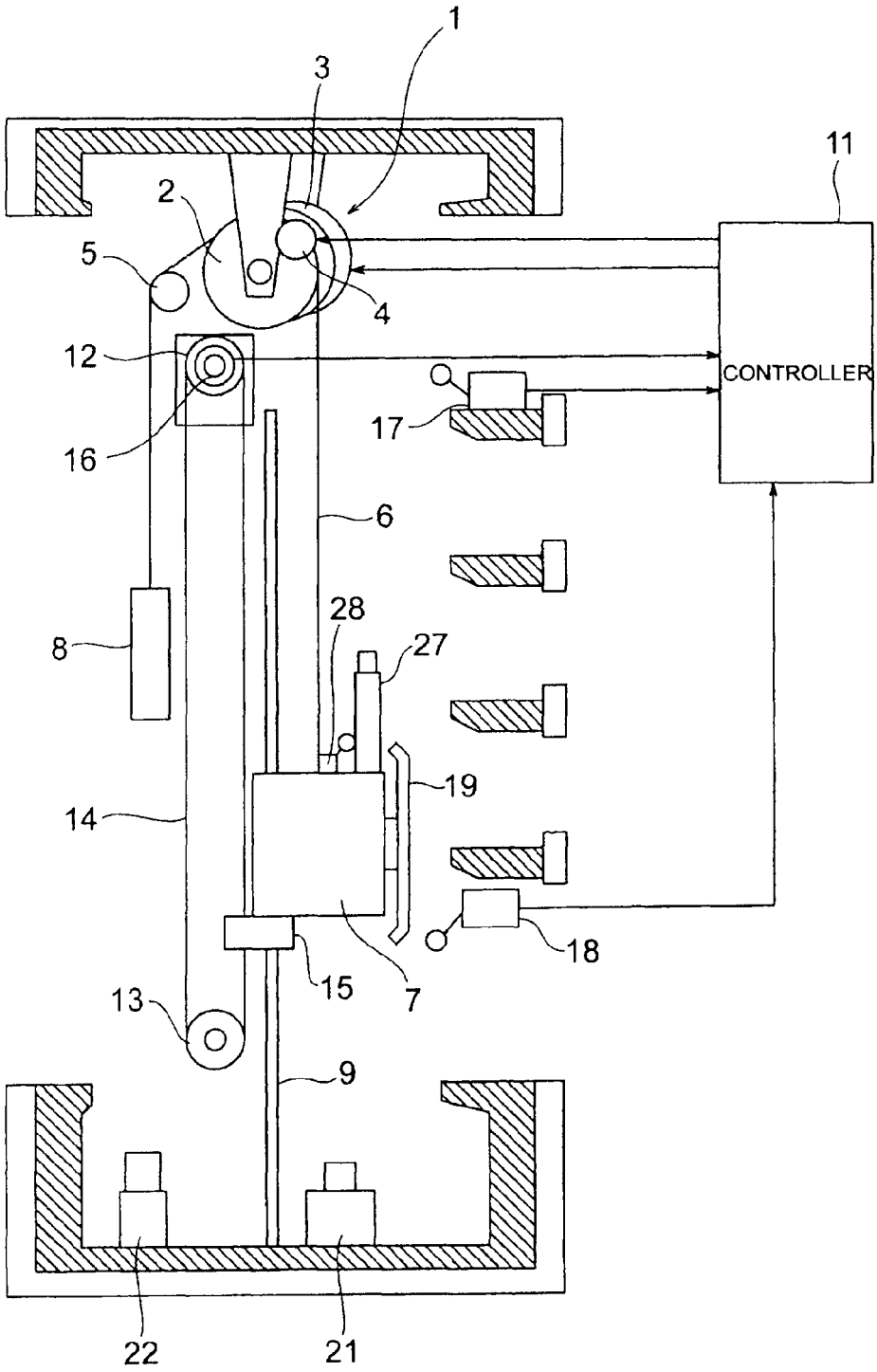
FIG. 6 A configuration diagram illustrating an elevator system according to a third embodiment of the present invention.

Next, FIG. 6 is a configuration diagram illustrating an elevator system according to a third embodiment of the present invention. In the drawing, a maintenance buffer 27 corresponding to a stopper is installed on the car 7 at the time of the maintenance work performed on the car 7. The maintenance buffer 27 is installed on the car 7 during the maintenance work to abut against the ceiling of the hoistway, thereby limiting the raised position of the car 7. The maintenance buffer 27 is removed from the car 7 at the time of the normal operation.

On the car 7, a maintenance buffer detection switch 28 corresponding to maintenance buffer detection means for mechanically detecting that the maintenance buffer 27 has installed onto the car 7 is provided. The maintenance buffer detection switch 28 is connected to the controller 11. Upon detection of the maintenance buffer 27 by the maintenance buffer detection switch 28, the controller 11 forcibly sets an operation mode of the car 7 to a maintenance operation mode. Other construction is the same as that in the first embodiment.

Figure 7:
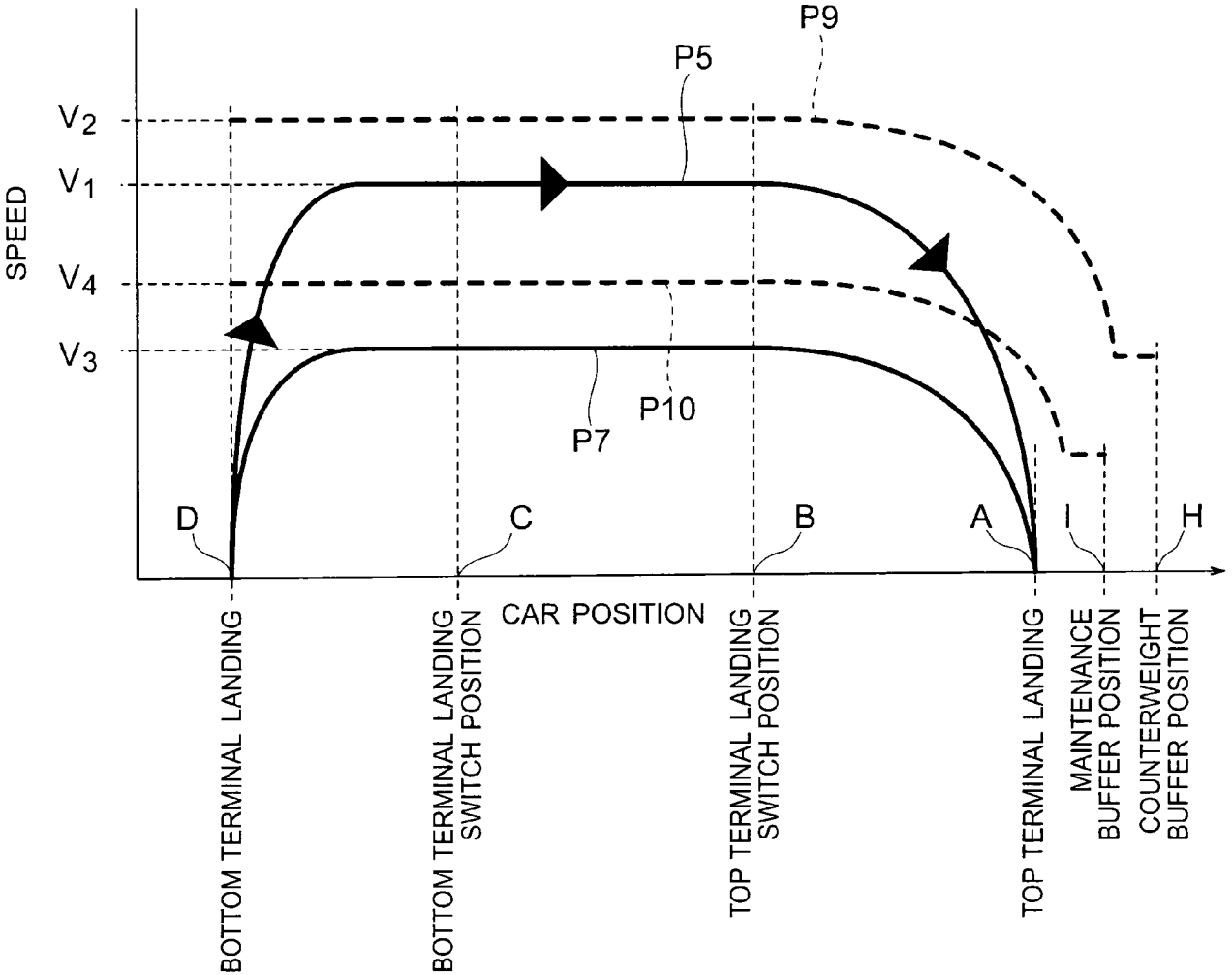
FIG. 7 A graph illustrating the overspeed pattern for the normal operation and the overspeed pattern for the maintenance operation, which are set for the controller illustrated in FIG. 6.

FIG. 7 is a graph illustrating the overspeed pattern for the normal operation and the overspeed pattern for the maintenance operation, which are set for the controller 11 illustrated in FIG. 6. The positions A to D and H are the same as those in FIG. 5. A position I is a position of the maintenance buffer 27, specifically, a position at which the rise of the car 7 is regulated by the maintenance buffer 27.

The overspeed serving as a criterion for the judgment of an abnormal car speed is set as a pattern according to a running direction and an absolute position of the car 7, specifically, as an overspeed pattern. Moreover, different overspeed patterns are set for the normal operation and the maintenance operation of the car 7, respectively.

In FIG. 7, a pattern P5 in a solid line, which has a maximum speed of V1, represents a running speed pattern when the normal operation of the car 7 is performed from the bottom terminal landing to the top terminal landing. A pattern P9 in a broken line, which has a maximum speed of V2, represents an overspeed pattern for the normal operation. A pattern P7 in a solid line, which has a maximum speed of V3, represents a running speed pattern when the maintenance operation of the car 7 is performed from the bottom terminal landing to the top terminal landing. A pattern P10 in a broken line, which has a maximum speed of V4, represents an overspeed pattern for the maintenance operation.

When the controller 11 judges that the car speed has reached the overspeed, the controller 11 de-energizes the motor 3 and causes the brake device 4 to perform the brake operation, thereby causing the car 7 to make an emergency stop. Moreover, when the installation of the maintenance buffer 27 onto the car 7 is detected by the maintenance buffer detection switch 28, the controller 11 switches the overspeed pattern from P9 to P10 to lower the set value of the overspeed. Moreover, the overspeed pattern is set so as to allow the collision speed of the counterweight 8 against the counterweight buffer 22 to be equal to or lower than the allowable collision speed according to the performance of the counterweight buffer 22 and so as to allow a collision speed of the maintenance buffer 27 against the ceiling of the hoistway to be equal to or lower than the allowable collision speed according to the performance of the maintenance buffer 27.

In the elevator system as described above, when the installation of the maintenance buffer 27 onto the car 7 is detected, the overspeed pattern is switched to automatically change the collision speed against the buffer. Therefore, even if the abnormality occurs in the control for the maintenance operation, the maintenance buffer 27 can be prevented from colliding against the ceiling of the hoistway at a speed exceeding the allowable collision speed of the maintenance buffer 27. As a result, the maintenance buffer 27 can be prevented from being damaged.

Moreover, the car 7 is inhibited from entering the top of the hoistway by the maintenance buffer 27 during the maintenance work performed on the car 7, and hence a work space for a maintenance person can be sufficiently ensured.

While the maintenance buffer 27 is described as the stopper to be installed onto the car 7 in the third embodiment, the maintenance buffer 27 is not necessarily required to be the buffer but may be a mere spacer. In this case, for example, an elastic member for buffering may be provided for an upper end portion of the stopper or for the ceiling of the hoistway.

While the maintenance buffer 27 is installed onto the car 7 in the third embodiment, a stopper may be provided on an upper portion of the counterweight 8 at the time of the maintenance work performed in the pit to limit the raised position of the counterweight 8, thereby to limit the lowered position of the car 7. In this case, it is sufficient to provide the stopper detection means on the counterweight.

Further, the stopper may be provided on the ceiling of the hoistway. Specifically, it is sufficient to provide the stopper onto at least one of the ascending/descending body and the ceiling of the hoistway so as to interpose the stopper between the ascending/descending body and the ceiling of the hoistway during the maintenance work.

Further, the running speed pattern during the normal operation and the running speed pattern during the maintenance operation may be set by independent devices (computers or the like), respectively.

The setting of the running speed pattern, the setting of the overspeed pattern, and the monitoring of the overspeed may also be executed respectively by independent devices (computers or the like). Specifically, a device for executing the function of controlling the travel of the car and a device for executing the function of monitoring whether or not the speed of the car reaches the overspeed may be provided in the controller as independent devices.

The stopper detection switch for mechanically detecting the installation of the stopper is used as the stopper detection means in the first to third embodiments, and hence the detection of the installation of the stopper is further ensured. However, the stopper detection means is not limited thereto. For example, the stopper may be detected in a non-contact manner by a proximity sensor, a photoelectric sensor, or the like.

Further, while the stopper detection means for directly detecting the installation of the stopper at its installation location is described in the first to third embodiments, the stopper detection means may indirectly detect the installation of the stopper by detecting the movement of the stopper from its storage location.

Further, the timing of lowering the set value of the overspeed is not limited to the installation of the stopper.

Fourth Embodiment

Next, a fourth embodiment of the present invention is described. In the fourth embodiment, the controller 11 controls the ascent/descent of the car 7 in a plurality of operation modes including a normal operation mode and a maintenance operation mode for raising and lowering the car 7 at a speed lower than that in the normal operation mode. Moreover, when the operation mode is switched to the maintenance operation mode, the controller 11 lowers the set value of the overspeed. The other configuration is the same as that in the first to third embodiments.

In the elevator system as described above, upon switching of the operation mode to the maintenance operation mode, the set value of the overspeed is automatically lowered. Therefore, when there is a possibility that the maintenance work is being performed in the hoistway, the speeds of the car 7 and the counterweight 8 can be more reliably kept down.

Fifth Embodiment

Next, a fifth embodiment of the present invention is described. In the fifth embodiment, an open/close state of each of a car door (not shown) and landing doors (not shown) is detected by a door opening/closing detection means (not shown). As the door opening/closing detection means, an existing door switch can be used. Moreover, the controller 11 lowers the set value of the overspeed when the door opening/closing detection means detects that at least one of the car door and the landing doors is opened. The other configuration is the same as that in the first to third embodiments.

In the elevator system as described above, the set value of the overspeed is automatically lowered when even one of the doors is opened. Therefore, when there is a possibility that the maintenance work is being performed in the hoistway, the speeds of the car 7 and the counterweight 8 can be more reliably kept down.

Sixth Embodiment

Next, a sixth embodiment of the present invention is described. In the sixth embodiment, the position of the car 7 is monitored by the controller 11. Moreover, the open/close states of the landing doors (not shown) are detected by the door opening/closing detection means (not shown). Moreover, when the door opening/closing detection means detects that the landing door at the floor other than the floor at which the car 7 currently stops is opened, the controller 11 lowers the set value of the overspeed. The other configuration is the same as that in the first to third embodiments.

In the elevator system as described above, the set value of the overspeed is automatically lowered when the landing door at the floor other than the floor at which the car 7 currently stops is opened. Therefore, when there is a possibility that the maintenance work is being performed in the hoistway, the speeds of the car 7 and the counterweight 8 can be more reliably kept down.

Seventh Embodiment

Next, a seventh embodiment of the present invention is described. In the seventh embodiment, the presence of a person on the car 7 is detected by means for people detection on top of the car (not shown). As the means for people detection on top of the car, various sensors for directly detecting a person on top of the car 7, a switch for detecting that a safety fence has been set up for work or the like may be used. When the presence of any person on top of the car 7 is detected by the means for people detection on top of the car, the controller 11 lowers the set value of the overspeed.

In the elevator system as described above, the set value of the overspeed is automatically lowered when the person is present on top of the car 7. Therefore, when there is a possibility that the maintenance work is being performed in the hoistway, the speeds of the car 7 and the counterweight 8 can be more reliably kept down.

The invention claimed is:

1. An elevator system comprising:

an ascending/descending body to be raised and lowered in a hoistway;

a controller for monitoring whether or not a speed of the ascending/descending body reaches a preset overspeed;

a buffer in a lower part of the hoistway;

a stopper being interposed between the buffer and the ascending/descending body at a time of maintenance work to limit a lowered position of the ascending/descending body; and stopper detection means for detecting installation of the stopper onto at least one of the buffer and the ascending/descending body, wherein the controller lowers a set value of the overspeed when the stopper is detected by the stopper detection means.

2. An elevator system comprising:

an ascending/descending body to be raised and lowered in a hoistway;

a controller for monitoring whether or not a speed of the ascending/descending body reaches a preset overspeed;

a stopper interposed between the ascending/descending body and a ceiling of the hoistway at a time of maintenance work to limit a raised position of the ascending/descending body; and stopper detection means for detecting installation of the stopper onto at least one of the ascending/descending body and the ceiling of the hoistway, wherein the controller lowers a set value of the overspeed when the stopper is detected by the stopper detection means.

3. The elevator system according to claim 1, wherein the stopper detection means is a stopper detection switch for mechanically detecting the installation of the stopper.

4. The elevator system according to claim 1, wherein the controller includes settings of an overspeed pattern for a normal operation and an overspeed pattern for a maintenance operation, and wherein the controller sets a current overspeed on the basis of information of a position of the body, information of a running direction of the body, information from the stopper detection means, and the overspeed pattern.

5. The elevator system according to claim 4, wherein the overspeed pattern in an area in a vicinity of a terminal landing is set to gradually decrease according to a distance to the terminal landing.

6. The elevator system according to claim 1, wherein the controller includes a device for executing a function of controlling a travel of the body and a device for executing a function of monitoring whether or not a speed of the body reaches the overspeed as independent devices.

7. The elevator system according to claim 2, wherein the stopper detection means is a stopper detection switch for mechanically detecting the installation of the stopper.

8. The elevator system according to claim 2, wherein the controller includes settings of an overspeed pattern for a normal operation and an overspeed pattern for a maintenance operation, and wherein the controller sets a current overspeed on the basis of information of a position of the body, information of a running direction of the body, information from the stopper detection means, and the overspeed pattern.

9. The elevator system according to claim 8, wherein the overspeed pattern in an area in a vicinity of a terminal landing is set to gradually decrease according to a distance to the terminal landing.

10. The elevator system according to claim 2, wherein the controller includes a device for executing a function of controlling a travel of the body and a device for executing a function of monitoring whether or not a speed of the body reaches the overspeed as independent devices.

* * * * *